United States Patent [19]

Chang et al.

[11] Patent Number: 4,769,022

[45] Date of Patent: Sep. 6, 1988

[54] CLEANSING PAD

[75] Inventors: Robert W. H. Chang; Joseph P. Kronzer, both of Roseville, Minn.

[73] Assignee: Minnesota Mining and Manufacturing Company, St. Paul, Minn.

[21] Appl. No.: 859,041

[22] Filed: May 2, 1986

[51] Int. Cl.[4] ..... A61F 13/16

[52] U.S. Cl. ..... 604/368; 604/304; 604/289; 128/355

[58] Field of Search ..... 604/289–293, 604/368, 369, 304, 307; 128/355; 15/230.12, 244 R

[56] References Cited

U.S. PATENT DOCUMENTS

| | | | |
|---|---|---|---|
| 3,463,745 | 8/1969 | Hofrichter | 604/289 |
| 3,686,024 | 8/1972 | Nankee et al. | 604/368 |
| 3,901,236 | 8/1975 | Assarsson et al. | 604/368 |
| 3,910,284 | 10/1975 | Orentreich | 128/355 |
| 3,983,095 | 9/1976 | Bashaw | 604/368 |
| 4,002,173 | 1/1977 | Manning et al. | 604/368 |
| 4,098,728 | 7/1978 | Rosenblatt | 604/368 |
| 4,204,983 | 5/1980 | Swarthaut et al. | 604/368 |
| 4,209,605 | 6/1980 | Hoy et al. | 604/368 |
| 4,320,201 | 3/1982 | Berg et al. | 604/368 |

FOREIGN PATENT DOCUMENTS

| | | | |
|---|---|---|---|
| 1176932 | 10/1984 | Canada | 604/304 |
| 0033235 | 8/1981 | European Pat. Off. | 604/368 |
| 0097846 | 1/1984 | European Pat. Off. | 604/304 |
| 2946553 | 5/1981 | Fed. Rep. of Germany | 604/368 |
| 0095917 | 12/1983 | Fed. Rep. of Germany | 604/368 |
| 0018917 | 2/1981 | Japan | 604/304 |
| 0110615 | 6/1984 | Japan | 604/304 |
| 0055955 | 4/1985 | Japan | 604/307 |
| 2061339A | 10/1980 | United Kingdom | |

*Primary Examiner*—C. Fred Rosenbaum
*Assistant Examiner*—Mark F. Colosimo
*Attorney, Agent, or Firm*—D. M. Sell; C. Truesdale

[57] ABSTRACT

A nonwoven cleansing pad is provided. The pad comprises high-sorbency, liquid sorbent fibers capable of forming a hydrogelatinous outer surface by sorption of liquid and thermally bondable binder fibers. The cleansing pad is substantially free of supplemental lubricant and is integrally self-lubricating when wet with water.

15 Claims, No Drawings

CLEANSING PAD

BACKGROUND OF THE INVENTION

This invention relates to nonwoven cleansing pads which are useful in the treatment of human skin for cosmetic and therapeutic purposes.

The epidermis is composed of several layers of cells. Round, moist, new cells are continuously being formed in the lower layer of the epidermis. The new cells rise to the skin surface over a period of 20 to 30 days during which time the cells gradually flatten, dry out and die. The dead cells in the uppermost layer are discontiguous and often appear loose and flaky and must be removed to permit the newer cells to rise to the surface. The cells in the layer beneath the uppermost layer, although also flattened and dead, are contiguous and densely compacted together. These contiguous cells will plump and soften when provided with water to give a smooth, flattering texture. These cells receive a steady supply of water from the dermis below but this supply is limited and frequently is not enough to plump and soften the cells on the surface of the skin.

Suitable cleansing treatments and preparations for cleansing the skin depend on the complexion, i.e., color and condition of the skin. Skin is generally classified as normal, dry and oily. Frequently, combinations of these are present, for example, dry and oily. Skin color influences the complexion with pale skin generally having a greater tendency to be dry and darker skin generally having a greater tendency to be oily. Any skin type can have a sensitive and/or blemished condition. Skin which is dry and sensitive requires special care to maintain optimum moisture and condition.

Dry skin is usually the result of dehydration, insufficient oil secretion and aging. Dry skin generally has a fine texture, but looks and feels tight and drawn. Dry skin chaps, flakes and peels easily. The cause of dry skin is the lack of water in the skin cells, not a lack of oil. When the water level in these dead cells near the surface is low, the cells become discontiguous, produce flakes and are rapidly shed from the skin surface.

Sensitive skin, which frequently is also dry, generally has a fine texture and often has a transparent appearance. The upper layers of sensitive skin are particularly thin and are likely to reveal broken capillaries. Sensitive skin reacts quickly to both external and internal influences such as sun, wind, food, drink and emotions. Sensitive skin requires a high moisture level as well as a high level of natural skin oils.

Although soap is an effective cleanser, cleansing with soap and water is not recommended for dry or sensitive skin. Soap removes the surface oil on the skin, leaving the skin without a protective film against excess evaporation of water. Soap also removes the upper layer of loose dead cells. However, on dry skin, these dead cells are easily removed without the use of soap.

Cleansing creams and lotions are often recommended as alternatives to soap but these cleansing creams and lotions may also have deleterious effects on various skin types. Cream cleansers such as cold cream or solidified mineral oil do not remove excessive amounts of oil and water from the skin. However, these cream cleansers are lacking in cleansing ability and leave a sticky greasy film on the skin which makes the complexion look dull and muddy. When soap or an after-cleansing freshener is used to remove this film, surface oil is also removed, leaving the skin without a protective film against excess evaporation of water.

Other cleansing creams and cleansing lotions which do provide adequate cleansing generally contain wax, mineral oil, alcohol, water and soap or detergent. These products provide adequate cleansing because of the soap or detergent present. When these products are rubbed into the skin and tissued off, a soap film may remain which draws water out of the skin. If an astringent rinse is used to remove the soap film, excessive drying can again occur.

Buffing pads for cleansing skin are disclosed in, for example, U.S. Pat. No. 3,910,284 (Orentreich). While such pads are useful for cleansing skin, they generally require lubrication with soap or cleansing cream to prevent excessive abrasion, resulting in the problems described above.

An autogeneously bonded absorbent pad is disclosed in U.K. Pat. No. 2,061,339 (Kimberly-Clark). The absorbent, or secretafacient, pad includes a batt of an intimate mixture of nonfusible absorbent fibers, such as rayon, wood pulp or other traditional cellulosic-based absorbent material and mild-process-fusible fibers. A small amount of superabsorbent-type material either in powder form or as additional fiber can be introduced into the batt. The intermixed fibrous batt is subjected to embossing by heat and pressure to give integrity to the batt.

SUMMARY OF THE INVENTION

The present invention provides a nonwoven cleansing pad comprising high-sorbency, liquid sorbent fibers capable of forming a hydrogelatinous outer surface by sorption of liquid and thermally bondable binder fibers, the cleansing pad being substantially free of supplemental lubricant and being integrally self-lubricating when wet with water. The term "substantially free of supplemental lubricant" means that no soap, cleansing cream or cleansing lotion is added to the pad but minor amounts of lubricant may be present from fiber processing. The cleansing pad may additionally contain abrasive fibers.

The cleansing pad of this invention effectively removes dirt, stale oil, perspiration and dead cells from the surface of the skin without the use of soap, cleansing cream or cleansing lotion. The cleansing pad can cleanse skin in a non-drying manner, leaving natural protective oil o the skin surface with only the addition of water to the pad

DETAILED DESCRIPTION OF THE INVENTION

The high sorbency, liquid sorbent fibers useful in the present invention are those which, on imbibition of water, form a hydrogelatinous surface. This hydrogelatinous surface provides a high degree of lubricity to the fiber and, thus, to the cleansing pad. Fibers which are capable of forming a hydrogelatinous surface generally swell at least five times, preferably at least ten times in diameter on imbibition of water. Such swelling can be readily observed by soaking the fiber in water for a short time, e.g., 30 seconds, draining the fiber, and observing the increase in fiber diameter.

The fibers which are capable of forming a hydrogelatinous surface have high water absorbency, i.e., preferably at least about 75 ml/g, more preferably at least about 100 ml/g, most preferably at least about 125 ml/g when tested by soaking the fibers in distilled water for 10 minutes and then draining the fiber for 5 minutes on a mesh screen. The fibers also exhibit high water retentivity under pressure. Water retention values are preferably at least about 20 ml/g, more preferably at least about 40 ml/g, most preferably at least about 50 ml/g, when a 5-kg weight is placed on a 2 g sample of fiber which has been soaked in water for 10 minutes and drained.

The sorbent fibers preferably have a dry diameter of from about 2 to 10 denier, more preferably from about 5 to 8 denier. The sorbent fibers are preferably staple fibers having an average length in the range of 2 to 15 centimeters. More preferably, the sorbent fibers are less than about 7 centimeters in length. The sorbent fibers are preferably crimped, to provide bulk and resiliency to the cleansing pad.

Useful sorbent fibers include an acrylonitrile fiber having a hydrophilic crosslinked polymer on the surface thereof such as "Lanseal" F, available from Japan Exlan Co., Ltd., Osaka, Japan.

The amount of sorbent fiber in the cleansing pad depends on the degree of lubricity desired. The sorbent fibers are preferably present in the cleansing pad in an amount of about 20 to 60 weight percent, more preferably about 30 to 50 weight percent, based on the weight of the cleansing pad.

The thermally bondable binder fibers provide integrity and strength to the cleansing pad and can be any thermally bondable synthetic fiber. The binder fibers also provide abrasive properties to the pad when of sufficiently high denier, e.g., 10 dpf or greater. The thermally bondable binder fibers can be monocomponent fibers or bicomponent fibers. The monocomponent fibers, i.e., those fibers having the same composition throughout their length and cross-section, can be of any thermoplastic bondable polymer, such as polyolefins, polyamides and copolyamides, polyesters and copolyesters, acrylics and the like. The bicomponent fibers or coated fibers generally have at least a portion that forms the outer surface of the fiber, i.e., the sheath or coating, of a lower softening point component and a core or base of a higher softening point component. The bicomponent fibers may also be of the side-by-side type, with the lower softening point component beside the higher softening point component along the length of the fiber. The lower softening point component provides the fiber with thermal bondability and the higher softening point component adds strength to the fiber and the cleansing pad. The lower melting component of the bicomponent fiber may be selected from thermoplastic bondable polymers, such as polyolefins, polyamides and copolyamides, polyesters and copolyesters, acrylics, and the like. The higher melting component of the bicomponent fiber may be selected from fiber-forming polymers, such as polyolefins, polyamides, polyesters, acrylics, and the like.

Normally, the thermally bondable fibers useful in the present invention preferably have a denier in the range of 1 to 50, more preferably 5 to 25, and a length in the range of 2 to 15 cm, more preferably less than about 7 cm, for ease of processability and web formation. Such fibers are well-known in the art.

A useful thermally bondable monocomponent fiber is a copolyester staple fiber produced from copolymers which melt and/or flow at temperatures substantially lower than conventional polyester polymer, i.e., at about 130° C., available from Eastman Fibers as "Kodel" 438 Binder Fibers.

A useful thermally bondable bicomponent fiber is an all polyester core/sheath fiber. The fiber is believed to comprise a core of polyethylene-terephthalate and a sheath of polyester resin comprising a random copolyester composite of 68% terephthalic acid units and 32% isophthalic acid units polymerized with ethylene glycol, and is available as "Melty Fiber Type 4080" from Unitika, Ltd., Osaka, Japan. The fiber core (base fiber) has a melting temperature of approximately 245° C. The sheath has a sticking temperature of about 110° to 120° C.

Another useful thermally bondable bicomponent fiber is an all polyolefin core-sheath fiber. The fiber is believed to comprise a core of polypropylene and a sheath of polyolefin at a 1:1 ratio, the sheath having a sticking temperature of 110° to 120° C. Such fiber is available as "Diawa NBF Type H" from Diawabo Co. Ltd., Osaka, Japan.

The amount of thermally bondable binder fiber in the cleansing pad depends on the strength and integrity desired in the cleansing pad. The thermally bondable binder fibers are preferably present in the cleansing pad in an amount of about 40 to 80 weight percent, more preferably about 60 to 70 weight percent, based on the weight of the cleansing pad. When abrasive fibers are present in the pad, the amount of binder fiber can be as low as 25 weight percent, but a concomitant reduction in strength results.

In addition to the sorbent fibers and the binder fibers, the cleansing pad can contain abrasive fibers to enhance the removal of dirt and dead cells by the cleansing pad. The abrasive fibers have low water absorbency and can be selected from synthetic fibers such as polyesters, polyamides, and polyolefin. Preferably the diameter of the abrasive fibers is in the range of 5 to 50 denier, more preferably 10 to 25 denier. The abrasive fibers are preferably staple fibers having an average length in the range of 2 to 15 cm. More preferably, the abrasive fibers are less than about 7 centimeters in length. The abrasive fibers are preferably crimped to provide additional bulk and resiliency to the cleansing pad. The amount of abrasive fiber in the cleansing pad depends on the degree of abrasion desired. The abrasive fibers can comprise as much as 30 to 40 weight percent of the cleansing pad. However, because the abrasive fibers are supplanting the sorbent fibers and/or the binder fibers, the cleansing pad will have reduced lubricity and/or strength and integrity.

The cleansing pad containing sorbent staple fibers and thermally bondable staple binder fibers, and, optionally, abrasive fibers can be prepared from a web formed using any conventional carding or airlayering process, such as a "Rando-Webber" available from Rando Machine Corporation, Macedon, N.Y. The web is then preferably needle tacked to entangle the fibers and reduce thickness. The needle tacked web is then heated at a temperature about 10° to 30° C. above the sticking temperature of the fiber for a period of time sufficient to cause fusion of the binder fibers, e.g., 10 to 30 seconds. This thermobonding provides the pad with strength and integrity.

The cleansing pad of the invention preferably has a weight in the range of 40 to 400 g/m$^2$, more preferably 85 to 125 g/m$^2$. The thickness of the pad is preferably between about 0.1 and 3 cm, more preferably between about 0.3 and 1 cm. To ensure adequate strength and durability, the tensile strength of the pad provided by needle tacking and thermal bonding is preferably at least about 0.5 kg/5 cm width, more preferably at least about 3 kg/5 cm width, in both the machine direction and cross direction when dry and preferably at least about 1 kg/5 cm width, more preferably at least about 3 kg/5 cm width, in both the machine direction and cross direction when wet.

The following specific, but non-limiting, examples will serve to illustrate the invention. In these examples, all percentages and parts are by weight unless otherwise indicated.

EXAMPLES

In the following examples the wet lubricity is determined using a static friction test and a kinetic friction test.

In the static friction test, a 7.5 cm×30 cm sample is submersed in water for 5 minutes. The sample is drained for 20 seconds, and placed on a horizontal wooden board 30 cm in length. A 6 cm diameter glass Petri dish cover containing a 30 g weight is placed on the wet sample. One end of the board is gradually raised until the weighted glass cover starts to slide down the sample. The static friction (SF) of the sample is reported as the height to which the end of the board must be raised to cause the weight to slide. The height to which the board must be raised to cause the weight to slide is preferably less than about 20 cm, more preferably less than about 10 cm.

In the kinetic friction test, a sample is prepared and wetted as in the static friction test. The sample is then placed on a horizontal surface. A 6-cm diameter glass Petri dish containing a 300 g weight is placed near one end of the sample. The force required to slide the weighted Petri dish along the sample surface is reported as the kinetic friction (KF). The kinetic friction is preferably less than about 150 g, more preferably less than about 100 g.

In the examples, the tensile strength was measured by elongating a 5 cm wide×22.9 cm long sample at a crosshead rate of 25.4 cm/min. to break. Dry and wet samples were tested in the machine direction (MD) and cross direction (CD). The results are reported in kg/5 cm width.

EXAMPLES 1-7

Webs were produced using 7 denier, 5.1 cm long "Lanseal" sorbent staple fibers, 15 denier, 3.8 cm long "Melty" binder fiber and 15 denier, 3.2 cm long polyester abrasive fiber (type 431, available from Eastman) in the amounts shown in Table 1. The fibers were air laid using a Rando Webber machine to form thin, fluffy webs having a thickness in the range of about 1.25 to 2.5 cm. The air laid webs were then needle tacked using the following conditions:

Needle type: Torrington Felting needle #78-1200-003
Needle board: 31.25 cm wide, 12.5 cm deep
Needle density: 12 rows deep, 25 needles/row
Needle speed: 195 strokes/minute
Penetration: 1.25 cm
Advance: 0.625 cm The webs were then heated for 20 seconds in an oven at 140° to 145° C. to bond the binder fibers, thus forming the cleansing pads of the invention.

TABLE 1

| Example | Sorbent fiber (%) | Binder fiber (%) | Abrasive fiber (%) |
|---|---|---|---|
| 1 | 20 | 80 | — |
| 2 | 25 | 75 | — |
| 3 | 30 | 70 | — |
| 4 | 35 | 65 | — |
| 5 | 40 | 60 | — |
| 6 | 50 | 50 | — |
| 7 | 60 | 40 | — |
| 8 | 30 | 40 | 30 |
| 9 | 45 | 30 | 25 |

The cleansing pads were then tested for weight, thickness, tensile strength, and static and kinetic friction. The results are shown in Table 2.

TABLE 2

| | | | Tensile Strength (kg) | | | | | |
|---|---|---|---|---|---|---|---|---|
| | | | Dry | | Wet | | Lubricity | |
| Example | Weight (g/m$^2$) | Thickness (cm) | MD | CD | MD | CD | SF (cm) | KF (g) |
| 1 | 159.5 | 0.36 | 10.1 | 5.9 | 9.1 | 6.2 | 19.6 | 80 |
| 2 | 158.2 | 0.29 | 7.5 | 6.0 | 5.7 | 5.5 | 17.8 | 70 |
| 3 | 155.0 | 0.41 | 4.8 | 5.1 | 4.9 | 4.6 | 19.6 | 90 |
| 4 | 158.2 | 0.42 | 4.7 | 4.0 | 5.4 | 3.4 | 16.5 | 80 |
| 5 | 161.2 | 0.40 | 3.7 | 3.5 | 3.5 | 3.4 | 17.8 | 90 |
| 6 | 180.8 | 0.43 | 8.4 | 7.0 | 7.6 | 4.9 | 5.7 | 60 |
| 7 | 187.3 | 0.43 | 6.3 | 4.9 | 5.4 | 4.4 | 4.4 | 40 |
| 8 | 161.5 | 0.36 | 2.5 | 2.6 | 2.0 | 2.3 | 19.6 | 100 |
| 9 | 161.5 | 0.39 | 1.9 | 1.0 | 4.1 | 4.3 | 17.8 | 100 |

COMPARATIVE EXAMPLES 1-9

In comparative examples 1-7, various fibers which are absorbent, but which do not form a hydrogel on the surface thereof when wet with water, and a binder fiber (15 denier, 3.8 cm long "Melty" fiber) were used to produce pads as described in examples 1-9. The fibers used include:

A: "Absorbit" rayon fiber, 3 denier, 4 cm long, available from American Enka Co.
C: cotton fiber, 1.5 denier, 1.3 cm long
R: rayon fiber, 1.5 denier, 4 cm long
V: vinyon fiber, 3 denier, 3.2 cm long In comparative examples 8 and 9, small amounts of 5.5 denier, 3.8 cm long "Lanseal" sorbent fibers, 15 denier, 3.8 cm long "Melty" fibers, and 1.5 denier, 4 cm long rayon fibers were used to produce pads as in examples 1-9. The compositions of the pads of the comparative examples are shown in Table 3.

TABLE 3

| Comparative Example | Fiber Type | Fiber % | Binder fiber (%) | Sorbent fiber (%) |
|---|---|---|---|---|
| 1 | A | 30 | 70 | — |
| 2 | A | 50 | 50 | — |
| 3 | C | 30 | 70 | — |
| 4 | C | 50 | 50 | — |
| 5 | R | 30 | 70 | — |
| 6 | R | 50 | 50 | — |
| 7* | V | 30 | 70 | — |
| 8 | R | 45 | 50 | 5 |

TABLE 3-continued

| Comparative Example | Fiber Type | Fiber % | Binder fiber (%) | Sorbent fiber (%) |
|---|---|---|---|---|
| 9 | R | 40 | 50 | 10 |

*Embossed as described in British Patent No. 2,061,339A

These comparative pads were then tested for weight, thickness, tensile strength, and static and kinetic friction. The results are shown in Table 4.

TABLE 4

| Comparative Example | Weight ($g/m^2$) | Thickness (cm) | Tensile Strength (kg) Dry MD | Dry CD | Wet MD | Wet CD | Lubricity SF (cm) | KF (g) |
|---|---|---|---|---|---|---|---|---|
| 1 | 165.6 | 0.34 | 15.2 | 12.5 | 10.7 | 11.0 | 21.6 | 225 |
| 2 | 157.2 | 0.36 | 4.5 | 4.9 | 3.8 | 5.0 | 26.7 | 325 |
| 3 | 136.5 | 0.36 | 8.2 | 11.2 | 5.5 | 8.4 | 20.3 | 200 |
| 4 | 163.6 | 0.45 | 4.1 | 6.4 | 1.3 | 5.0 | 28.0 | 270 |
| 5 | 161.7 | 0.31 | 8.5 | 9.9 | 6.7 | 9.1 | 28.0 | 250 |
| 6 | 175.3 | 0.36 | 3.4 | 5.8 | 3.8 | 6.7 | 28.0 | 260 |
| 7 | 129.4 | 0.04 | 18.1 | 19.1 | 10.9 | 12.3 | 26.7 | 220 |
| 8 | 167.5 | 0.25 | 2.9 | 5.5 | 2.2 | 4.8 | 28.0 | 300 |
| 9 | 158.5 | 0.25 | 2.3 | 5.0 | 2.0 | 4.5 | 23.0 | 200 |

As can be seen from the data in Tables 2 and 4, the cleansing pads of the invention containing the sorbent fiber, which has a hydrogelatinous surface when wet, in amounts of 20 to 60 weight percent has much greater lubricity than the comparative pads containing absorbent fibers which do not have hydrogelatinous surfaces when wet.

EXAMPLE 8

A web was made as in Examples 1–7 containing 40 weight percent 5.5 denier, 5.1 cm long "Lanseal" sorbent fibers, 40 weight percent 3.5 denier, 3.8 cm long "Kodel" 438 binder fiber, and 20 weight percent 15 denier, 3.2 cm long polyester abrasive fiber. The web was not needle tacked. The web was thermally bonded at about 150° C. and lightly pressed with a roller while the binder fiber was still molten to improve bonding. The web was again thermally treated at 150° C. to improve bulk. The thus-prepared pad had good integrity in both the dry and wet state and had good lubricity when wet with water.

What is claimed is:

1. A nonwoven cleansing pad comprising high-sorbancy, liquid sorbent fibers capable of forming a hydrogelatinous outer surface by sorption of liquid and thermally bondable binder fibers, said binder fibers being fused to provide said pad with strength and integrity, said cleansing pad being substantially free of supplemental lubricant and being integrally self-lubricating when wet with water.

2. The cleansing pad of claim 1 wherein said sorbent fibers comprise about 20 to 60 weight percent of said pad.

3. The cleansing pad of claim 1 wherein said sorbent fibers swell at least five times in diameter on imbibition of water.

4. The cleansing pad of claim 1 wherein said sorbent fibers have a dry diameter of about 2 to 10 denier and are 2 to 15 cm long.

5. The cleansing pad of claim 1 wherein said binder fibers comprise about 40 to 80 weight percent of said pad.

6. The cleansing pad of claim 1 wherein said binder fibers are about 1 to 50 denier and 2 to 15 cm long.

7. The cleansing pad of claim 1 further comprising abrasive fibers.

8. The cleansing pad of claim 7 wherein said abrasive fibers comprise up to 35 weight percent of said pad.

9. The cleansing pad of claim 7 wherein said abrasive fibers are about 5 to 50 denier and 2 to 15 cm long.

10. The cleansing pad of claim 7 comprising about 20 to 60 weight percent sorbent fibers, 20 to 40 weight percent binder fibers, and 20 to 40 weight percent abrasive staple fibers.

11. The cleansing pad of claim 1 wherein said pad has a static friction lubricity of less than about 20 cm.

12. The cleansing pad of claim 1 wherein said pad has a kinetic friction lubricity of less than about 150 g.

13. The cleansing pad of claim 1 wherein the weight of said pad is in the range of about 40 $g/m^2$ to 400 $g/m^2$.

14. The cleansing pad of claim 1 wherein the thickness of said pad is in the range of about 0.1 to 3 cm.

15. A method of cleansing human skin comprising manually rubbing said skin with the cleansing pad of claim 1 to remove dirt, stale oil, perspiration, and dead cells from said skin.

* * * * *

UNITED STATES PATENT AND TRADEMARK OFFICE

CERTIFICATE OF CORRECTION

PATENT NO. : 4,769,022

DATED : September 6, 1988

INVENTOR(S) : ROBERT W. H. CHANG and JOSEPH P. KRONZER

It is certified that error appears in the above-identified patent and that said Letters Patent is hereby corrected as shown below:

Col. 2, l. 48, "o" should be -- on -- .

Signed and Sealed this

Eleventh Day of April, 1989

*Attest:*

DONALD J. QUIGG

*Attesting Officer*

*Commissioner of Patents and Trademarks*